United States Patent [19]

Gornall

[11] 4,000,579

[45] Jan. 4, 1977

[54] ANIMATED CLACKER

[76] Inventor: Victor Joseph Gornall, 11423 Nashville, Detroit, Mich. 48205

[22] Filed: June 13, 1975

[21] Appl. No.: 586,531

[52] U.S. Cl. ..... 46/154; 40/126 R

[51] Int. Cl.[2] ..... A63H 5/00

[58] Field of Search ..... 46/154, 1 L, 11, 126; 40/126 R, 126 A, 126 B

[56] References Cited

UNITED STATES PATENTS

| | | | |
|---|---|---|---|
| 2,130,343 | 9/1938 | Havel | 46/11 X |
| 2,819,559 | 1/1958 | Daley | 46/1 L X |
| 3,468,055 | 9/1969 | Hunt | 46/126 |

*Primary Examiner*—F. Barry Shay

*Attorney, Agent, or Firm*—Harness, Dickey & Pierce

[57] ABSTRACT

A manually operable animated toy clacker having particular utility as a device for the display of advertising material, the device being made from sheet material such as relatively stiff paper or the like and having relatively large, opposed, flapable portions joined to a middle portion by symmetrical, oppositely curved score lines and having also animation parts attached to the flaps or to the middle portion so that, when the latter is squeezed endwise, it and the flaps move in different directions and at different rates and thereby cause the attached animation parts to move in a controlled manner to produce a uniquely interesting, always attractive and sometimes humorous effect.

3 Claims, 4 Drawing Figures

ANIMATED CLACKER

BACKGROUND OF THE INVENTION

More particularly, when the middle portion of the clacker of this invention is squeezed endwise, the outer or flap portions of the clacker move toward each other about the score lines; and when pressure against the middle portion is released, the flap portions separate or move apart. The free end edges of the middle portion are long enough to be gripped solidly and securely between the thumb and an opposed finger of the operator and this makes it possible for the operator or user to apply considerable force against the middle portion so that the latter in turn imposes sufficient leverage on the flap portions to cause them to come together with a loud clacking noise. The attached animation parts referred to above may assume a variety of shapes and may simulate any number of things in order to achieve a desired effect. For example, a part which simulates a face can be attached to one of the flaps, a part which simulates a tongue can be attached to the middle portion between the two flaps, and a part which simulates a hat may extend through a slot in the first mentioned flap and be attached to the other flap. Then, when the clacker is manipulated in the manner described, the attached parts move back and forth to give an animated effect. This action affords amusement and makes the device attractive as a toy — especially for small children. It also provides a convenient and desirable means for displaying advertising of various kinds; and the fact that the device also serves as a toy, makes the display of the advertisement particularly effective. The device itself is simple and it can be made inexpensively so that it is uniquely adaptable for use as a giveaway or premium item in an advertising program.

PRIOR ART

The following art is made of record herein. The U.S. Pat. to Daley No. 2,819,559 dated Jan. 14, 1958; the U.S. Pat. to Smart No. 2,680,935 dated June 15, 1954, the U.S. Pat. to Lewis No. 3,597,296 dated Aug. 3, 1971, and the publication classified in 46/16.

SUMMARY OF THE INVENTION

The essential novelty of this device is believed to reside in the concept of combining the animation parts with the basic structure of the clacker in such a way as to produce an animated, attractive and amusing effect.

DESCRIPTION OF THE PREFERRED EMBODIMENT

Figure 1:
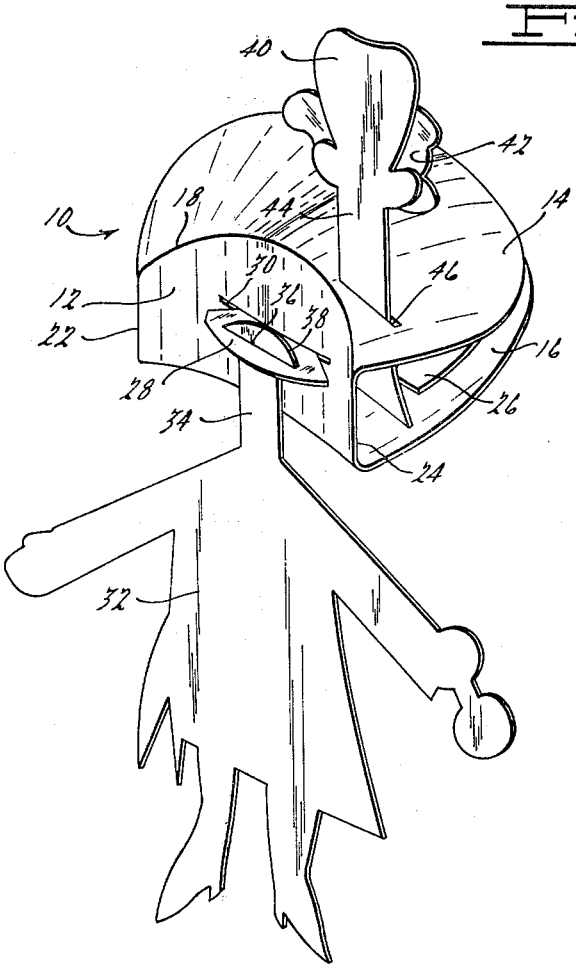
FIG. 1 is a perspective view showing the clacker of this invention from the rear and one side thereof with the flap portions together.

Reference is now had to the accompanying drawings wherein the numeral 10 designates a one-piece body of relatively stiff sheet material such as cardboard or the like. The body 10 here shown has a middle portion 12 and end flap portions 14 and 16 which are joined to the middle portion at opposite sides thereof along oppositely curved score lines 18 and 20, respectively. The opposite free end edges 22 and 24 of the middle portion 12 are sufficiently long to accommodate the thumb and finger of the user comfortably to manipulate the clacker in the manner shown in FIG. 4.

The score lines 18 and 20 are oppositely arcuately curved in such a way that the portion 12 increases progressively in width from the ends to the middle thereof. Further, the score lines 18 and 20 are symmetrically arranged and uniformly spaced from the transverse axes of the body 10 so that the middle portion 12 also is symmetrical with respect to the transverse axes. In fact, the body 10 preferably is symmetrical about both its transverse and longitudinal axes. It will be apparent also that the size and shape of the flap portions 14 and 16 can vary somewhat in size and shape; but they should of course be sufficiently long so that they come together at or adjacent to the outer edges thereof and thus touch each other with force and a clacking sound when the middle portion 12 is flexed and bent in the manner described.

Figure 2:
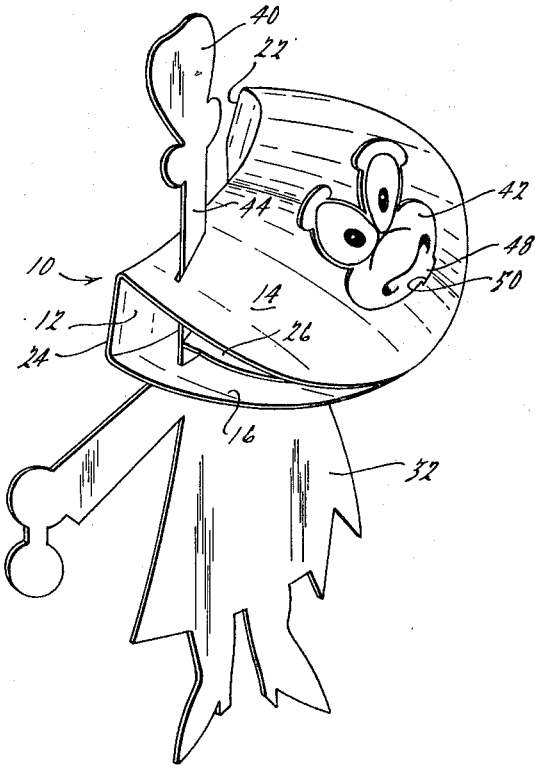
FIG. 2 is a perspective view from the front and one side and showing the flap portions of the clacker together.
Figure 3:
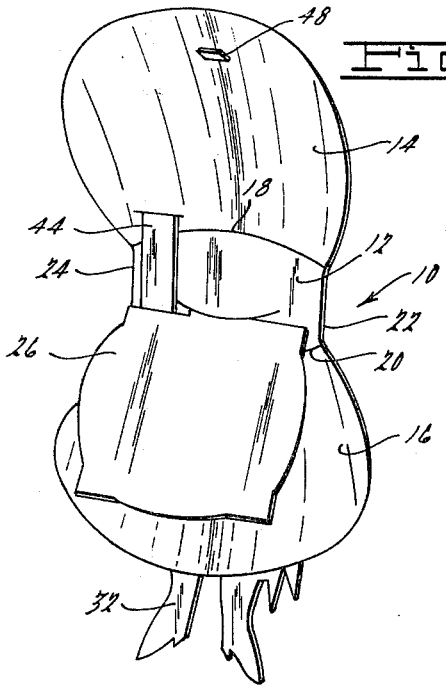
FIG. 3 is a view similar to FIG. 2 showing the clacker from the outside but with the flap portions thereof spaced apart.
Figure 4:
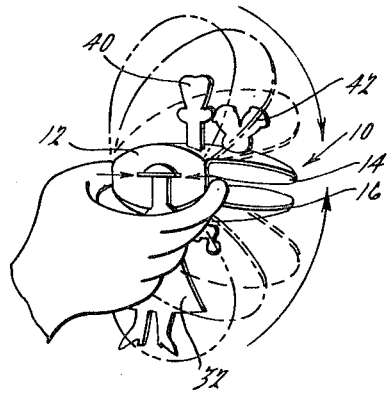
FIG. 4 is a perspective view illustrating the mode of use of the clacker.

The generally oblate oval shape of the middle portion 12 and the particular shape and disposition of the score lines 18 and 20 causes the flap portions 14 and 16 to swing toward and away from each other when the ends of the middle portion 12 are alternately squeezed and relaxed, as shown in FIG. 4, and the long free edges 22 and 24 of the middle portion 12 permit the flap portions to be brought together with sufficient force so that they make a relatively loud noise which permits the device to function as a clacker. The simplest way of performing this operation of course is to grasp the two edges 22 and 24 of the middle portion 12 between the thumb and finger of one hand, as shown. When pressure is applied against the ends 22 and 24, the middle portion 12 is caused to bow or arch away from the palm of the hand by which it is held; and, as this action occurs, the flap portions 14 and 16 swing toward each other until the outer edges thereof meet, as shown in FIGS. 1 and 2. Contrariwise, when pressure against the ends of the middle portion 12 is released, the middle portion tends to straighten or flatten out; and, as this action takes place, the flap portions 14 and 16 separate or move apart substantially as shown in FIG. 3. Manifestly, then, by alternately applying and releasing pressure against the middle portion 12, the end portions 14 and 16 can be made to open and close alternately, as illustrated in FIG. 4.

As suggested, the device of this invention makes an interesting and attractive medium for the display of advertising. The flap portions 14 and 16 particularly can be attractively decorated; and if desired, suitable advertising indicia can be appropriately placed on either or both of the inner and outer surfaces thereof. Attention is instantly attracted to the advertisements when the flap portions 14 and 16 are flapped and clacked back and forth by manipulation of the middle portion 12 in the manner hereinabove described.

In addition, it will be readily apparent that the basic form of the device is a rough simulation or burlesque of a mouth. As a result, the device provides a basic form that can be easily modified to enhance this illusory characteristic and to give the clacker animation.

For example, a simulated tongue 26 can be appended to the inner side of the middle portion 12 and if desired teeth or the like (not shown) can be attached to the inner sides of the flap portions 14 and 16 adjacent their peripheries to enhance this illusion. In practice, the tongue 26 can be attached to the middle portion 12 in any suitable manner. In the particular form of the invention shown, the tongue 26 is provided at the inner edge thereof with a rearwardly projecting tab 28 which extends through a slot 30 in the middle portion 12 and the side edges of the tab 28 are flared outwardly, as shown in FIG. 1, so that the tab interlocks with the slot 30 to prevent the tab from inadvertently pulling out of the slot in use.

The adaptation of the clacker to enhance animation is further advanced by attaching a body part 32 to the projecting end of the tab 28. In the particular embodiment shown, the part 32 is shaped to at least approximately simulate a human body. It has an upwardly projecting neck portion 34 which extends through a slot 36 in the tab 28 and the projecting terminal portion 38 of the neck is wider than the latter to interlock the body 32 with the tab 28.

Animation of the clacker is further enhanced by hat-shaped and face-shaped parts 40 and 42 respectively both disposed above and associated with appropriate portions of the upper flap 14. As shown, the hat-shaped part 40 is formed with a downwardly extending elongate tab 44 which extends through and loosely fits a slot 46 which is formed in the upper flap 14 at one side thereof and adjacent to the score line 18. The lower end of the tab 44 is adhesively or otherwise secured in any suitable manner to the lower flap 16 directly below the slot 46. The face-shaped part 42 on the other hand, is attached to the upper flap 14 at substantially the middle thereof and adjacent to the free or swinging edge thereof. In the particular form of the invention shown, the face-shaped part 42 is formed with a downwardly projecting tab 48 which extends through a slot 50 in the flap 14. Ideally, the tab 48 is held relatively loosely in association with the flap 14 simply by frictional engagement of the edges which define the slot 50 with the opposite sides of the tab. This arrangement holds the face-shaped part 42 reasonably securely on the flap 14 but at the same time permits the part 42 to flop back and forth as the flap moves during manipulation of the clacker.

It will be noted that all of the appended animated parts 26, 40 and 42 are attached to parts of the clacker that flex or otherwise move during manipulation and operation of the device. Thus, the moving parts of the clacker impart corresponding movements to the animated parts. The simulated tongue 26 is caused to move forwardly and rearwardly; viz., in and out between the two flaps 14 and 16 as the middle part 12 alternately arches and straightens during manipulation of the clacker. At the same time, the body 32 swings back and forth on the projecting terminal portion of the tab 28. Alternate downward and upward movement of the lower flap 16 causes the hat-shaped part 40 to move up and down relative to the upper flap 14. On the other hand, upward and downward movement of the upper flap 14 causes the face-shaped part 42 to wobble or flop back and forth in simulated animation. All of these actions occurring simultaneously give an interesting and sometimes comical animated effect to the clacker and enhance its ability to draw attention to advertising material printed thereon or attached thereto in some manner. When the device is used for advertising purposes, an appropriate theme can be built around the illusion thus created adding interest and increasing attention to the advertising media and the loud clacking noise which the device makes in use augments the interest and attention. As will be apparent, the device of this invention is an inexpensive toy that affords the user, and particularly small children, great amusement.

Manifestly, other modifications can be employed in a variety of ways most suitable for a particular situation; and these variations are almost infinite, being limited only by the imagination of the user.

I claim:

1. A device comprising an elongate one-piece clacker element of essentially stiff but flexible sheet material having a middle member and end flap members joined to said middle member along spaced score lines which diverge substantially uniformly from the opposite ends of said middle member, said middle member having relatively long, free, gripping edges at the ends thereof of sufficient length to receive and comfortably accommodate the thumb and finger of one hand, whereby alternate endwise compression and release of said middle member causes the latter alternately to arch and straighten and said flap members to swing toward and from each other about said score lines and the edge portions of said flap members to strike each other with force, said clacker element having in combination therewith animation parts attached to said members so that movement of the latter in use causes said parts to move relative to said members in simulated animation, at least one of said animation parts being attached to said middle member and supported by at least one of said flap members, whereby flexure of said middle member in use causes said one part to move in and out between said flap members.

2. The combination as set forth in claim 1 wherein said one part is attached to said middle member by a tab portion which extends through and projects beyond said middle member and at least one other of said animation parts is attached to the projecting portion of said tab and is induced in use to swing back and forth relative to the clacker by the combined motion of said middle member and said one part.

3. A device comprising an elongate one-piece clacker element of essentially stiff but flexible sheet material having a middle member and end flap members joined to said middle along spaced score lines which diverge substantially uniformly from the opposite ends of said middle member, said middle member having relatively long, free, gripping edges at the ends thereof of sufficient length to receive and comfortably accommodate the thumb and finger of one hand, whereby alternate endwise compression and release of said middle member causes the latter alternately to arch and straighten and said flap members to swing toward and from each other about said score lines and the edge portions of said flap members to strike each other with force, said clacker element having in combination therewith animation parts attached to said members so that movement of the latter in use causes said parts to move relative to said members in simulated animation, at least one of said animation parts having a tab portion which extends through and slidably fits an opening in one of said flap members and is attached to the other of said flap members.

* * * * *